US008505172B2

(12) United States Patent
Termanini

(10) Patent No.: US 8,505,172 B2
(45) Date of Patent: Aug. 13, 2013

(54) REMOVABLE POUCH PARTITION

(76) Inventor: Zafer Termanini, Cedar Grove, NJ (US)

( * ) Notice: Subject to any disclaimer, the term of this patent is extended or adjusted under 35 U.S.C. 154(b) by 58 days.

(21) Appl. No.: 12/798,071

(22) Filed: Mar. 29, 2010

(65) Prior Publication Data

US 2010/0293757 A1 Nov. 25, 2010

Related U.S. Application Data

(60) Provisional application No. 61/211,470, filed on Mar. 30, 2009.

(51) Int. Cl.
*B65D 33/16* (2006.01)

(52) U.S. Cl.
USPC ..... 24/30.5 R; 24/30.5 L; 383/38; 383/59

(58) Field of Classification Search
USPC ..... 24/460, 462, 30.5 L, 30.5 S, 30.5 R; 383/63, 38, 59
See application file for complete search history.

(56) References Cited

U.S. PATENT DOCUMENTS

| | | | | |
|---|---|---|---|---|
| 3,008,835 | A * | 11/1961 | Madding | 426/120 |
| 3,149,943 | A * | 9/1964 | Amador | 62/4 |
| 3,639,952 | A * | 2/1972 | Thompson et al. | 24/462 |
| 5,370,221 | A * | 12/1994 | Magnusson et al. | 206/221 |
| 5,613,282 | A * | 3/1997 | Deddens et al. | 24/30.5 R |
| 6,074,094 | A * | 6/2000 | Manolizi et al. | 383/5 |
| 6,286,670 | B1 * | 9/2001 | Smith | 206/221 |
| 6,648,133 | B1 * | 11/2003 | Blaschke et al. | 206/221 |
| 2001/0030134 | A1 * | 10/2001 | Goglio et al. | 206/221 |
| 2008/0000056 | A1 * | 1/2008 | Murray | 24/460 |

* cited by examiner

*Primary Examiner* — Robert J Sandy
*Assistant Examiner* — Michael Lee
(74) *Attorney, Agent, or Firm* — Samir Termanini, Esq.

(57) ABSTRACT

A removable pouch partition clip having the same length of a pouch's folds. Said clip has a transverse hole at each end to allow the insertion of retaining pin to prevent the accidental slippage of the clip during shipping, which may release the partition folds and allow unwanted contamination or communication between the two compartments. Said clip has a figure of U. The edges of the U have reinforcement for increased rigidity. Each end of the clip may have a retaining pin that penetrates through corresponding holes in the pouch's folds. The retaining pins may be replaced with heat spot welds. Pulling the pouches apart will disengage the pins and remove the clip allowing the pouches to communicate.

11 Claims, 4 Drawing Sheets

REMOVABLE POUCH PARTITION

CROSS REFERENCE TO RELATED APPLICATION

This application claims the benefit of U.S. Provisional Patent Application Ser. No. 61/211,470 filed on Mar. 30, 2009 and entitled " REMOVABLE POUCH PARTITION," the entirety of which is incorporated herein by reference.

BACKGROUND OF THE INVENTION

1. Field of the Invention

The present invention relates generally to removable pouch partition and more specifically it relates to a removable pouch partition clip holding tightly several folds of the pouch in its middle thereby creating two adjacent compartments. Said partition created by the removable clip, located between the adjacent compartments is air and watertight.

2. Description of the Prior Art

It can be appreciated that pouch partitions have been in use for years. Typically, a pouch partition is comprised of permanent heat seals or pressure cements that cannot be used as a removable temporary partition between two pouches. The main problem with conventional removable pouch partition is that their permanent seals are not removable in nature. Another problem with conventional removable pouch partitions (such as Zip Lock™) is that they cannot provide adequate seal between two adjacent compartments. Other problems with existing removable partitions are that they are difficult to reach for removal, especially when contained within a pouch. While these devices may be suitable for the particular purpose to which they address, they are not as suitable for providing a removable clip holding tightly several folds of the pouch in its middle thereby creating two adjacent compartments said partition created by the removable clip, located between the adjacent compartments is water tight. The main problems with conventional removable pouch partitions are that their permanent seals are not removable in nature. Another problem is cannot provide adequate seal between two adjacent compartments, or are difficult to reach. In these respects, the removable pouch partition according to the present invention substantially departs from the conventional concepts and designs of the prior art and in so doing provides an apparatus primarily developed for the purpose of providing a removable clip holding tightly several folds of the pouch in its middle thereby creating two adjacent compartments. Said partition created by the removable clip, located between the adjacent compartments is air and watertight.

SUMMARY OF THE INVENTION

In view of the foregoing disadvantages inherent in the known types of removable pouch partition now present in the prior art, the present invention provides a new removable pouch partition construction wherein the same can be utilized for providing a removable clip holding tightly several folds of the pouch in its middle thereby creating two adjacent compartments. Said partition created by the removable clip located between the adjacent compartments is air and watertight.

The general purpose of the present invention, which will be described Subsequently in greater detail, is to provide a new removable pouch partition that has many of the advantages of the removable pouch partition mentioned heretofore and many novel features that result in a new removable pouch partition which is not anticipated, rendered obvious, suggested, or even implied by any of the prior art removable pouch partition, either alone or in any combination thereof. To attain this, the present invention generally comprises a figure U shaped clip having the same length of the pouch folds. Said clip has a transverse hole at each end. The purpose of said hole is to allow the insertion of holding pin. Said pin will prevent the accidental slippage of the clip which may release the folds and allow unwanted contamination or communication between the two compartments. There has thus been outlined, rather broadly, the more important features of the invention in order that the detailed description thereof may be better understood, and in order that the present contribution to the an may be better appreciated.

There are additional features of the invention that will be described hereinafter. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting. A primary object of the present invention is to provide a removable pouch partition that will overcome the shortcomings of the prior art devices. An object of the present invention is to provide a removable pouch partition for providing a removable clip holding tightly several folds of the pouch in its middle thereby creating two adjacent compartments. Said partition created by the removable clip, located between the adjacent compartments is air and watertight. Another object is to provide a removable pouch partition that will provide a removable seal between two compartments.

Another object is to provide a removable pouch partition that said seal is removable allowing communication between the two adjacent compartments. Another object is to provide a removable pouch partition that Said seal is air and water tight. Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE ENABLING EMBODIMENTS

Figure 1:
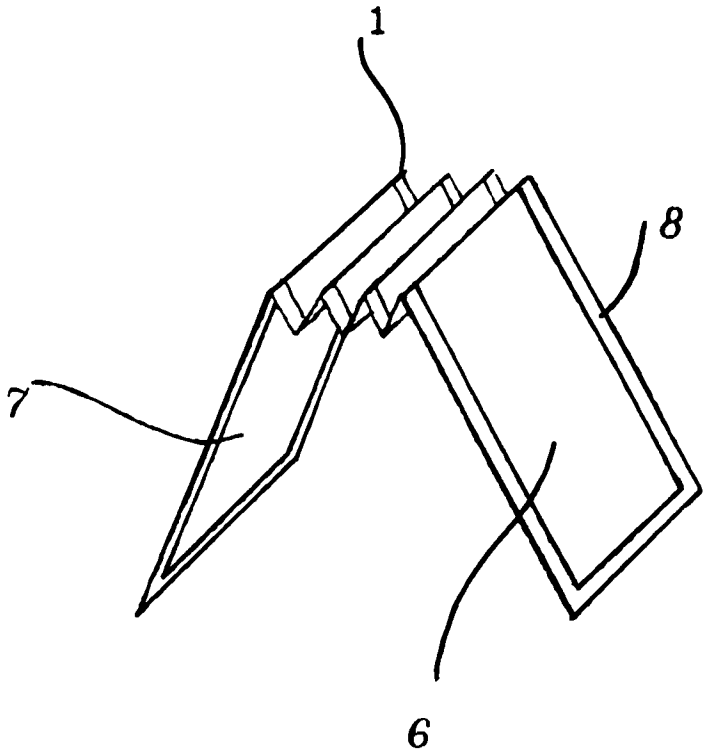
FIG. 1 is perspective view of the pouch with the folds.
Figure 2:
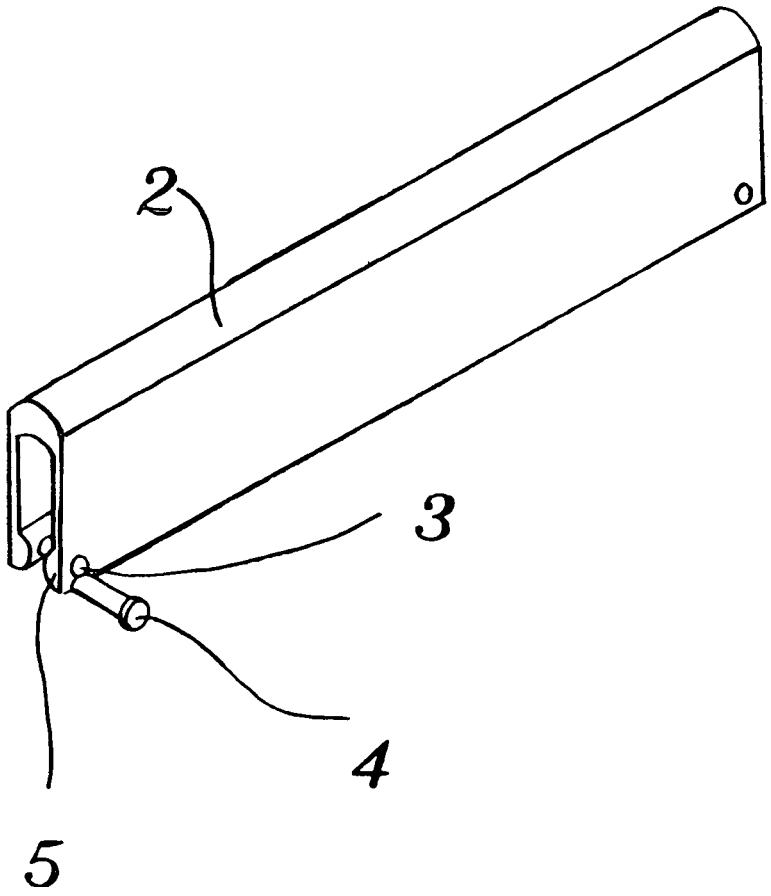
FIG. 2 is perspective view of the clip and the retaining pin.
Figure 3:
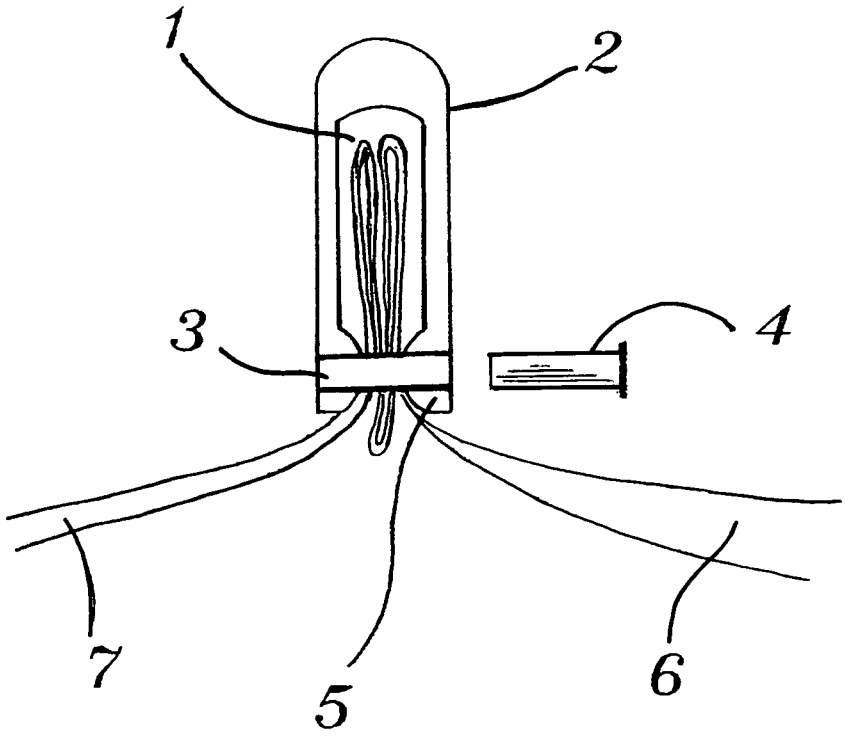
FIG. 3 is a cross section of the clip, retaining pin and the folds.

Turning now descriptively to the drawings, in which similar reference characters denote similar elements throughout the several views, the attached figures illustrate a removable pouch partition which comprises a figure of U shaped clip (2) having the same length of the pouch folds (1). Said clip (2) has a transverse hole (3) at each end. The purpose of said hole (3) is to allow the insertion of holding pin (4). Said pin (4) will prevent the accidental slippage of the clip (2) during shipping, which may release the folds (1) and allow unwanted contamination or communication between the two compartments (6, 7). Said clip (2) has a figure of U shape and a length equal to the length of the folds (1). The edges of the U have reinforcement (5) for increased rigidity. Each end of the clip (2) has a hole (3) which will allow the insertion of a retaining pin (4). The retention pin (4) will penetrate through corresponding holes (3) and through the pouch's folds (1). Said pin (4) will prevent the accidental slippage of the dip during shipping. The accidental slippage of the clip (2) risk to allow communication between the two adjacent compartments (6, 7) and). The clip (2) is made of rigid plastic or light alloy or other structurally similar material.

A variation of the present invention may include simple replacement of the retention pin (4) by a heat weld spot in the location of the hole (3) on either end of the clip (2). Once the first compartment (6) of the pouch is filled with it content, the pouch is folded several times (a minimum of three). The folds (1) have a width equal to the depth of the U clip (2). Once the U clip (2) is applied to hold the folds (1), the retaining pins (4) are inserted in place at each end of the U clip (2). Following this, the second compartment (7) of the pouch is filled and sealed with a heat sealer.

Figure 4:
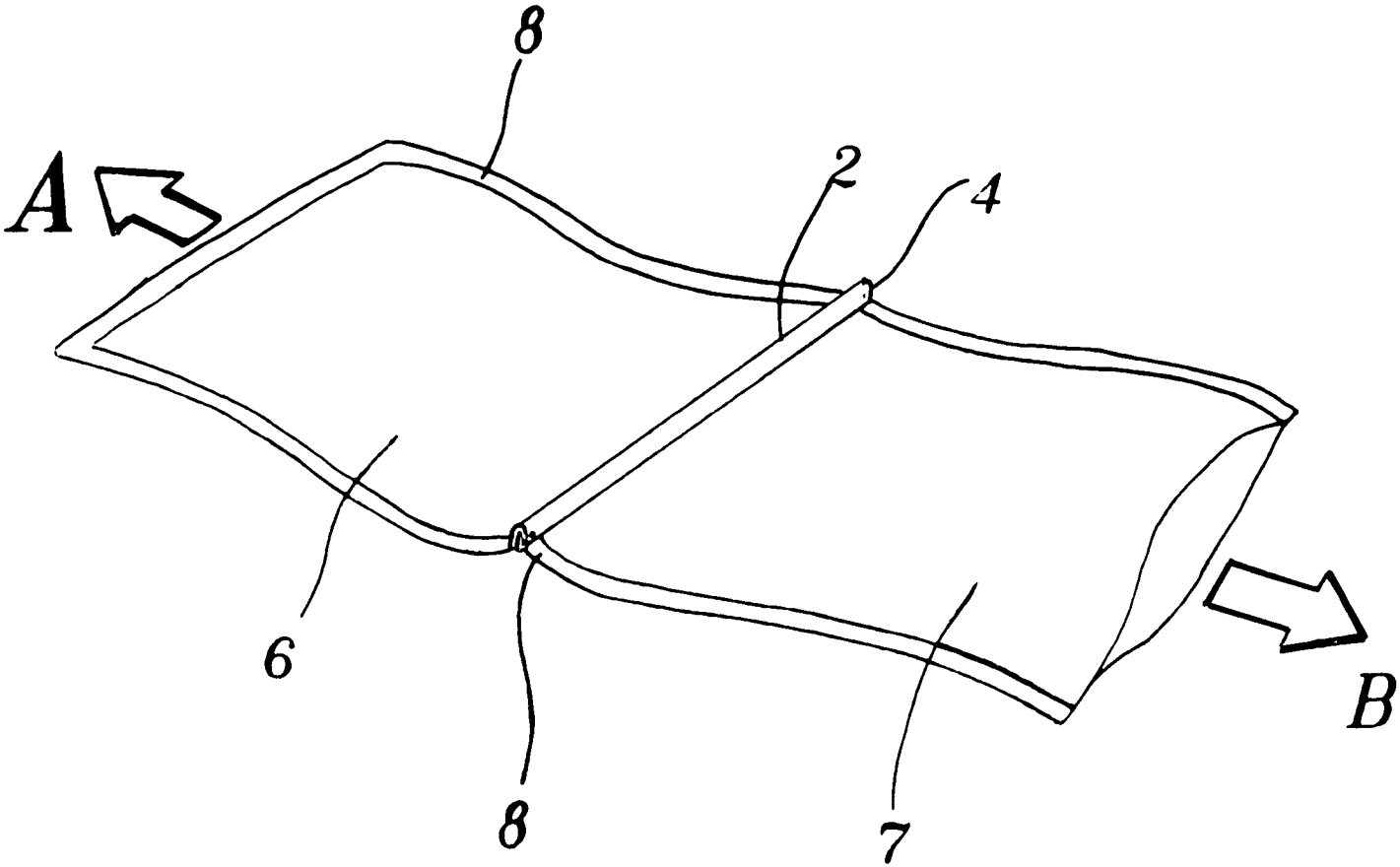
FIG. 4 is a perspective view of the removable clip in place, separating two compartments.

To remove the partition and release the clip (2), the operator simply applies a pull or longitudinal traction to the end of each pouch as depicted in FIG. 4. This will spread the limbs of the U shaped clip (2) apart. By doing so, the retaining ping is release from one hole (3) and the folds (1) are released and flatten, thereby allowing the two compartments (6, 7) to communicate.

As to a further discussion of the manner of usage and operation of the present invention, the same should be apparent from the above description. Accordingly, no further discussion relating to the manner of usage and operation will be provided. With respect to the above description then, it is to be realized that the optimum dimensional relationships for the parts of the invention, to include variations in size, materials, shape, form, function and manner of operation, assembly and use, are deemed readily apparent and obvious to one skilled in the and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A removable pouch partition system comprising: a flexible enclosure, said flexible enclosure having a first compartment and a second compartment, wherein fluid communication between said first compartment and said second compartment is prevented by a flat folded region having an odd number of sequentially alternating 180 degree transverse folds across said flexible enclosure, whereby said flat folded region consists of folding said flexible enclosure back and forth directly upon itself;

a U-shaped fastener, wherein said fastener comprises two parallel opposable clamping members each having a transversely disposed interior reinforced retaining lip for compressing said flat folded region upon engagement, whereby said fastener is slidably secured thereupon to thereby prevent unfolding of said flat folded region; and whereby said U-shaped fastener is slidably released upon the application of longitudinal traction to said first compartment and said second compartment.

2. The removable pouch partition system claimed in claim 1, wherein said U-shaped fastener has a length equal to the length of said plurality of transverse folds and said clip has an inside depth equal to the width of said plurality of transverse folds.

3. The removable pouch partition system claimed in claim 1, wherein said flexible enclosure further comprises: a top layer; and a bottom layer; and wherein both layers are heat sealed along their outer periphery thereby forming a heat sealed peripheral zone.

4. The removable pouch partition system claimed in claim 3, wherein said U-shaped fastener further comprises one or more transverse holes, each for receiving a retaining pin that penetrates through said heat sealed peripheral zones of said plurality of transverse folds.

5. The removable pouch partition system claimed in claim 1 wherein three transverse accordion folds prevent fluid communication between said first compartment and said second compartment across said flexible enclosure.

6. The removable pouch partition system claimed in claim 1, wherein said U-shaped fastener is constructed from a polymer.

7. The removable pouch partition system claimed in claim 1, wherein said U-shaped fastener is constructed from a metal alloy.

8. A removable pouch partition system comprising:

a heat sealed flexible enclosure, said flexible enclosure having a first compartment adjacent to a second compartment, wherein fluid communication between said first compartment and said second compartment is prevented by a flat folded region haying an odd number of sequentially alternating 180 degree transverse folds across said heat sealed flexible enclosure, whereby said flat folded region consists of folding said flexible enclosure back and forth directly upon itself; and a U-shaped fastener, wherein said fastener comprises two parallel opposable clamping members each having an transversely disposed interior reinforced retaining lip;

wherein said fastener is slidably secured thereby compressing said plurality of transverse folds and preventing unfolding of said two or more transverse folds.

9. The removable pouch partition system claimed in claim 8, wherein said U-shaped fastener has a length equal to the length of said plurality or transverse folds and said clip has an inside depth equal to the width of said plurality of transverse folds.

10. The removable pouch partition system claimed in claim 8, wherein said U-shaped fastener further comprises a plurality of transverse holes, each for receiving a retaining pin for securement by penetrating through said heat seal of said plurality of transverse folds.

11. The removable pouch partition system claimed in claim 8, wherein three transverse accordion folds prevent fluid communication between said first compartment and said second compartment across said heat sealed flexible enclosure.

* * * * *